US009085910B2

(12) United States Patent
Stewart

(10) Patent No.: US 9,085,910 B2
(45) Date of Patent: Jul. 21, 2015

(54) PLASTER CEILING SUPPORT DEVICE

(75) Inventor: Roderick Milton Stewart, Port Hope (CA)

(73) Assignee: HISTORIC PLASTER CONSERVATION PRODUCTS LIMITED, Port Hope (CA)

( * ) Notice: Subject to any disclaimer, the term of this patent is extended or adjusted under 35 U.S.C. 154(b) by 993 days.

(21) Appl. No.: 13/180,172

(22) Filed: Jul. 11, 2011

(65) Prior Publication Data

US 2013/0015306 A1 Jan. 17, 2013

(51) Int. Cl.
*E04F 21/00* (2006.01)
*E04G 17/16* (2006.01)

(52) U.S. Cl.
CPC ..... *E04F 21/00* (2013.01); *E04G 17/16* (2013.01)

(58) Field of Classification Search
CPC ..... E04B 9/061; E04F 21/1805; E04G 1/22; E04G 3/22; B66F 3/10
USPC ..... 254/98, 100, 134, 133 R, 103; 269/266, 269/21; 248/37.3, 65, 125.1, 354.3, 200.1, 248/295.11, 58, 230.1, 230.5, 214, 231.61; 24/514, 525, 569; 403/188
See application file for complete search history.

(56) References Cited

U.S. PATENT DOCUMENTS

| | | | | | |
|---|---|---|---|---|---|
| 116,672 | A | * | 7/1871 | Bowker | 254/98 |
| 1,068,442 | A | * | 7/1913 | Millis | 254/100 |
| 1,264,261 | A | * | 4/1918 | Blankenship | 254/100 |
| 1,279,901 | A | * | 9/1918 | Philips | 254/100 |
| 2,237,230 | A | * | 4/1941 | Johnson | 254/98 |
| 2,536,972 | A | * | 1/1951 | Woodworth | 254/98 |
| 2,671,697 | A | * | 3/1954 | North | 425/62 |
| 2,889,126 | A | * | 6/1959 | Morrison | 108/146 |
| 3,012,750 | A | * | 12/1961 | Schermerhorn, Jr. | 248/230.9 |
| 3,776,499 | A | * | 12/1973 | Turner et al. | 248/298.1 |
| 3,797,793 | A | * | 3/1974 | Moritz et al. | 248/295.11 |
| 3,815,858 | A | * | 6/1974 | Mocny et al. | 248/295.11 |
| 3,854,685 | A | * | 12/1974 | Parduhn | 248/214 |
| 3,900,179 | A | * | 8/1975 | Mocny et al. | 248/287.1 |
| 4,214,841 | A | * | 7/1980 | Hayashi | 403/188 |
| 4,519,236 | A | * | 5/1985 | Celette | 72/457 |
| 4,860,985 | A | * | 8/1989 | Olson et al. | 248/229.17 |
| 4,899,963 | A | * | 2/1990 | Murphy | 248/65 |
| 5,199,675 | A | * | 4/1993 | DeGuchi | 248/62 |
| 5,779,387 | A | * | 7/1998 | Schonauer | 403/400 |
| 5,894,769 | A | * | 4/1999 | Rogers et al. | 81/484 |
| 5,944,468 | A | * | 8/1999 | McBrien | 414/11 |
| 6,122,811 | A | * | 9/2000 | Shirley | 29/281.1 |
| 6,726,163 | B2 | * | 4/2004 | Eppard et al. | 248/219.4 |

OTHER PUBLICATIONS

Phillips, Morgan, W., "Adhesives for the Reattachment of Loose Plaster", Bulletin of the Association for Preservation Technology, vol. XII, No. 2, 1980, 28 pages.

* cited by examiner

*Primary Examiner* — Joseph J Hail
*Assistant Examiner* — Arman Milanian
(74) *Attorney, Agent, or Firm* — Hanley, Flight & Zimmerman, LLC

(57) ABSTRACT

A device for supporting a plaster ceiling during conservation work. A plurality of the devices may be installed on a superstructure of pipes or other rigid members installed on scaffolding to provide for a network or pattern of supporting devices in some installations. The supporting device includes a screw jack and a jack base that is configured to be attached to the superstructure, which in some cases includes horizontal pipes. The jack base may, in some embodiments, be symmetrical top to bottom so as to be useable on either side of a pipe and easily rotatable to either position.

19 Claims, 4 Drawing Sheets

PLASTER CEILING SUPPORT DEVICE

FIELD

The present application generally relates to restoration work in connection with plaster ceilings and, in particular, to a device for supporting a plaster ceiling during restoration work.

BACKGROUND

Many historic and architecturally significant buildings have plaster ceilings, many of which have delicate painted or applied decorations. In many of these buildings, over time, the plaster becomes structurally compromised as the mechanical keys that physically hold the plaster onto the lath break. In some cases, the plaster begins to pull away from the lath and starts to sag or fall.

Conservation and restoration work aims to preserve plaster ceilings that are in danger of sagging or falling. In the course of doing the conservation work, the plaster must be prevented from falling or further sagging during the conservation treatments. In some cases in the past, plaster ceilings have been supported during conservation work with crude props. For example, a flat padded board, such as plywood with a felt or cotton padding on one side, may be pressed against the plaster ceiling and held in place with one or more stout wooden props. This is sometimes termed a "deadman". In some cases, instead of a prop the padded board may be held in place with spring-loaded or telescoping poles.

These crude conventional mechanisms for supporting plaster ceilings have disadvantages. A large padded board obscures from view the very plaster ceiling that is the subject of the conservation effort. The props and spring-loaded posts are only crudely adjustable and can apply excessive pressure against the damaged plaster, thereby resulting in additional damage. In some cases, the additional damage results in the collapse of the ceiling when the temporary support is removed.

Many ceilings in historic buildings are at a significant height. In cases where a network of props or posts are used to support such a ceiling, it can be very difficult to install the scaffolding necessary for workers to engage in the conservation work. Moreover, some excessively long props or posts are too flexible to provide secure support.

In some instances, scaffolding may be installed prior to installation of ceiling supports. In these cases, posts or props may be put in place that are supported by the working surface of the scaffolding. However, workers walking on the working surface cause deflections in the scaffolding floor that are transferred directly to the posts or props and, thus, to the padded board supporting the ceiling. These deflections can cause additional damage to the plaster.

It would be advantageous to provide for another method and device for supporting plaster ceilings.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

The present application describes a device for supporting a plaster ceiling during conservation work. A plurality of the devices may be installed on a superstructure of pipes or other rigid members installed on the solid structure of scaffolding to provide for a network or pattern of supporting devices in some installations. The supporting device includes a screw jack and a jack base that is configured to be attached to the superstructure, which in some cases includes horizontal pipes. The jack base may, in some embodiments, be symmetrical top to bottom so as to be useable on either side of a pipe and easily rotatable to either position.

In one aspect, the present application describes a jack base for supporting a screw jack, the screw jack having a longitudinal threaded shaft with a diameter and a nut on the screw bolt. The jack base includes two spaced-apart side panels defining a gap between them at least as large as the diameter of the threaded shaft, each side panel having a top edge, an inner edge, and an outer edge, wherein the top edges each have an upward protrusion proximate the outer edges; a cross member extending between the two side panels; and a stopping member protruding above the top edges and spaced from the upward protrusions. The top edges of the side panels between the upward protrusions and the stopping member form a seat for the nut when the screw bolt is between the side panels. The jack base may be secured to a superstructure using a clamp passing between the side panels and over the cross member.

In another aspect, the present application describes a support device for supporting a plaster ceiling during conservation work. The support device includes a jack base as described above or herein; a screw jack including a threaded shaft, a nut on the threaded shaft, a coupling nut on an upper end of the threaded shaft, and a contact pad on the upper end of the coupling nut, the threaded shaft having a diameter; and a clamp for securing the jack base to a horizontal pipe, wherein the clamp is a worm gear clamp passing between the side panels and around the cross member.

Other aspects and features of the present application will be understood by those of ordinary skill in the art from a review of the following description of examples in conjunction with the accompanying figures.

Figure 1:
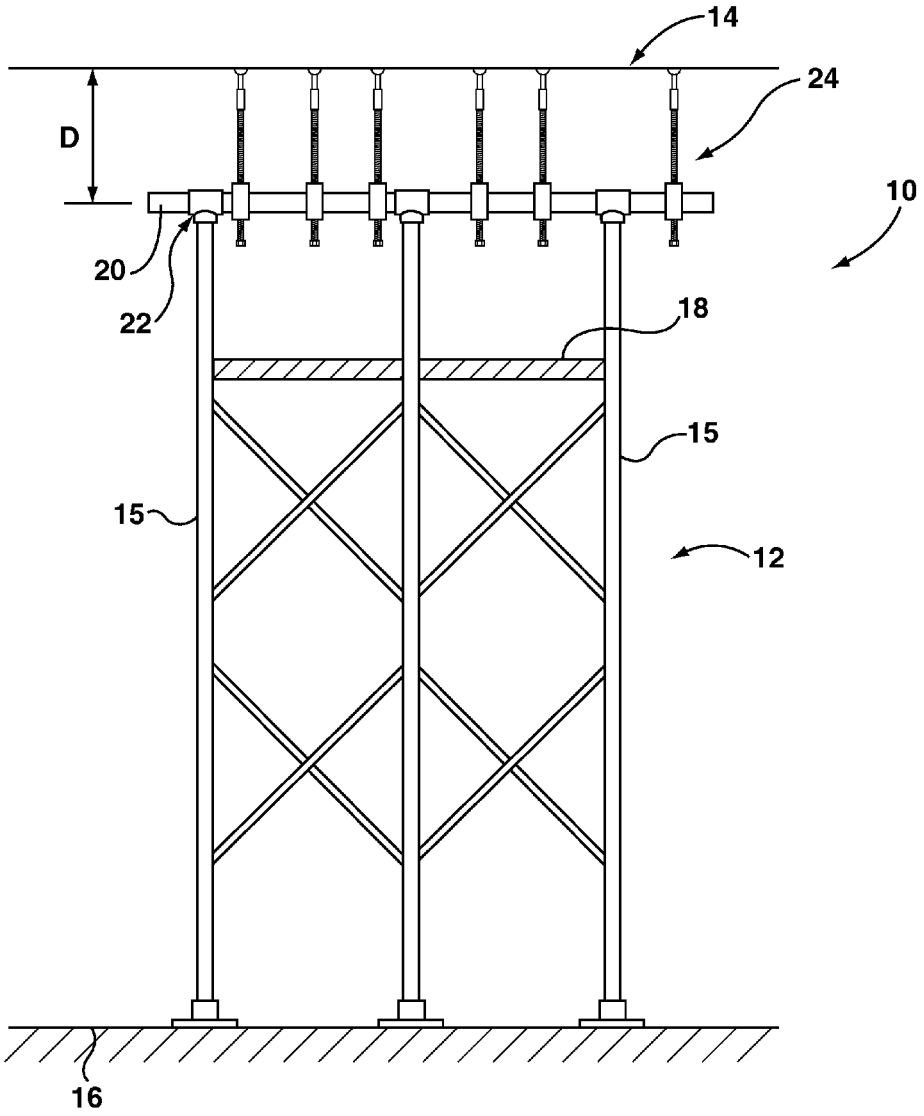
FIG. 1 shows a side view of a conservation installation including scaffolding and a support device.

Reference is now made to FIG. 1, which diagrammatically shows a partial side view of a conservation installation 10. The installation 10 is established in a building that includes a plaster ceiling 14 and a solid floor 16. The installation 10 includes temporary scaffolding, indicated generally by reference numeral 12. The scaffolding 12 includes a number of vertical pipes 15 interconnected by crossbeams or members in a known manner. The scaffolding 12 supports a suspended work surface 18 to enable personnel to stand atop the work surface 18 to reach the ceiling 14 in order to carry out restoration or conservation work.

The scaffolding 12 is installed such that the vertical pipes 15 (which may, in many embodiments, include multiple pipes fit together end-to-end, or telescoping pipes, instead of solid single piece pipes) extend to within 6" to 18" below the ceiling 14, as indicated by distance D. In some cases, the scaffolding 12 will include horizontal pipes fit to the end of the vertical pipes 15 and interconnecting them. In any case, a series of spaced-apart horizontal pipes 20 are installed at the top of the scaffolding 12. The horizontal pipes 20 are secured to the top of the scaffolding 12 using any conventional fasteners (for example, indicated by reference numeral 22) to hold the pipes 20 in place and ensure downwards force upon the horizontal pipes 20 is transferred directly to the vertical pipes 15 of the scaffolding 12 and thus to the floor 16. The series of horizontal pipes 20 may each be spaced apart about 24-36". The series of horizontal pipes 20 provides a superstructure below the ceiling 14 to which one or more support devices 24 may be affixed to support the ceiling 14 during the conservation work.

Figure 2:
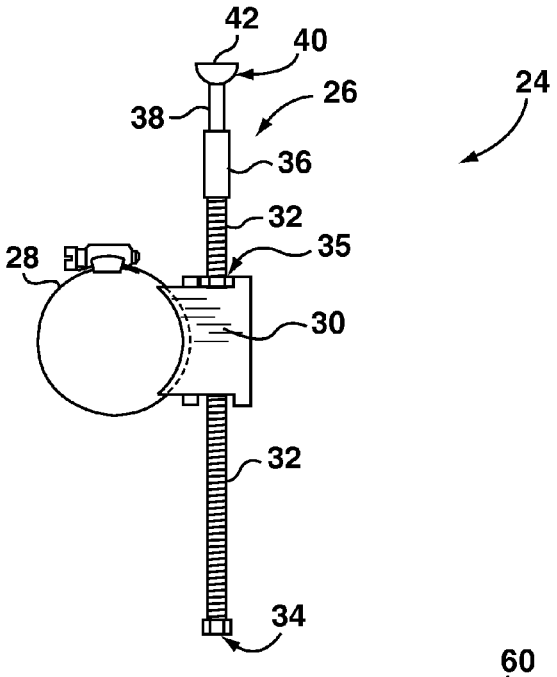
FIG. 2 shows an example embodiment of the support device.

Reference is now made to FIG. 2, which shows an example support device 24. The support device 24 includes a screw jack 26 and a jack base 30. The jack base 30 is configured to be clamped or otherwise secured to one of the horizontal pipes 20. In this example, the jack base 30 may be secured to one of the pipes 20 using a worm gear clamp 28 (often referred to as a Jubilee Clip™). Other clamps or fasteners may also be used with suitable modifications to the jack base 30, provided they hold the jack base 30 in a rigid position against the horizontal pipe 20.

The jack base 30 supports the screw jack 26. The screw jack 26 includes a long threaded shaft 32 onto which has been screwed a collar or nut 35, such as a weld nut. As will be described further below, the weld nut 35 is sized to be supported by a top surface of the jack base 30 and to fit within a seat formed therein. The threads of the screw jack 26 may be machine threads, acme-type threads, or other suitable threads that permit relatively fine adjustment without slipping.

The bottom end of the threaded shaft 32 may include a head 34 for rotation of the threaded shaft 32. The head 34 may permit use of an electric nut runner as well as a hand wrench for precision adjustment of the screw jack 26.

The screw jack 26 further includes a contact pad 40 at its upper end. The contact pad 40 may have a suitable padded surface 42 at its top side. The padded surface 42 may be formed using silicone paper, foam rubber, felt, or other suitable materials for the ceiling type and condition. The size of the contact point provided by the padded surface 42 may be sized for the specific conditions of the plaster and the installation. A small contact area is often preferable, particularly if the plaster features a valuable painting; however, it may be desirable to increase the size of the contact point to distribute the force evenly in some cases.

The contact pad 40 may, in some embodiments, be created using a swivel-adjustable furniture glide 38. The furniture glide 38 may be attached to the threaded shaft 32 using a modified coupling nut 36. The coupling nut 36 may be modified by removing approximately half its internal threads so that it may be removably fit atop the threaded shaft 32. The furniture glide 38 may be screwed into the other half of the coupling nut 36.

With the jack base 30 secured to one of the horizontal bars 20 (FIG. 1), and the screw jack 26 in place as shown in FIG. 2, the contact pad 40 may be extended upwards to come into contact with the ceiling 14 (FIG. 1) by rotating the threaded shaft 32. The contact force between the contact pad 40 and the ceiling 14 is passed through the weld nut 35 to the jack base 30, and from there to the horizontal pipe 20 and, thus, to the vertical scaffolding pipes 15 and the floor 16.

Figure 3:
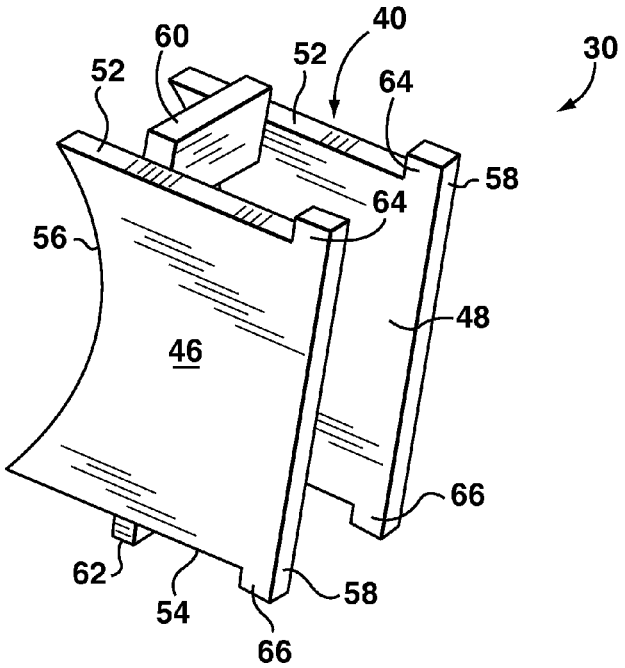
FIG. 3 shows an upper side perspective view of the example support device.
Figure 4:
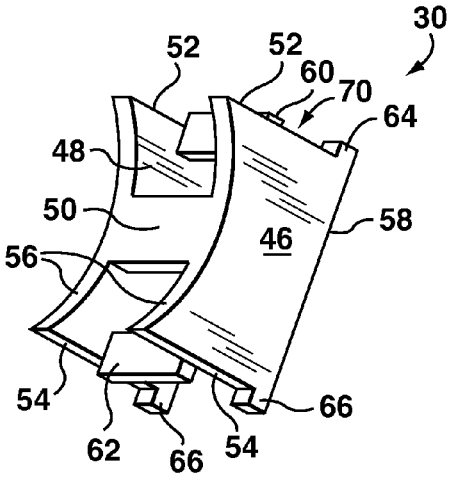
FIG. 4 shows a lower side perspective view of the example support device.
Figure 5:
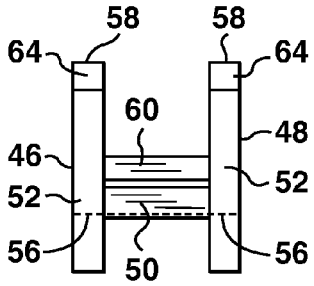
FIG. 5 shows a top view of the example support device.
Figure 6:
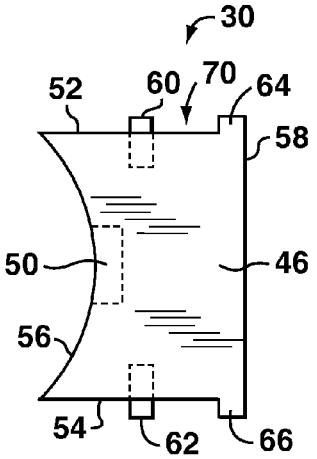
FIG. 6 shows a side view of the example support device.
Figure 7:
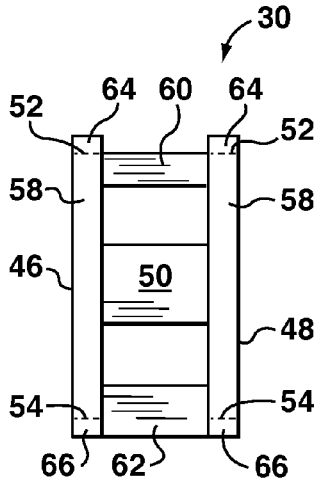
FIG. 7 shows a front view of the example support devices.

Reference will now be made to FIGS. 3 to 7. FIG. 3 shows an upper side perspective view of an example embodiment of the jack base 30. FIG. 4 shows a lower side perspective view of the example jack base 30. FIG. 5 shows a top view of the example jack base 30. FIG. 6 shows a side view of the example jack base 30. FIG. 7 shows a front view of the example jack base 30.

The jack base 30 is formed from two spaced-apart side panels 46, 48. A cross member 50 holds the two side panels 46, 48 in spaced relation. The side panels 46, 48 have top edges 52, bottom edges 54, inner edges 56, and outer edges 58. The gap formed between the inner surfaces of the side panels 46, 48 is sized to accommodate the diameter of the threaded shaft 32 (FIG. 2).

The inner edges 56 are concave, in this embodiment. The radius of the concave curve is sized based upon the radius of the horizontal pipe 20 (FIG. 1) to which the jack base 30 is to be secured.

The cross member 50 may be any suitable size or shape and may be formed integrally with the side panels 46, 48. The cross member 50 provides structural stability to the jack base 30 and is the portion of the jack base 30 around which a clamp may be placed to secure the jack base 30 to the horizontal pipe 20. The cross member 50 may be located proximate to or adjacent to the inner edges 56. In one embodiment, the outer surface of the cross member 50 is continuous with and curved at the same radius as the inner edges 56, as shown in FIGS. 4 and 6.

Also providing some structural integrity is an upper stopping member 60 and lower stopping member 62. The upper and lower stopping members 60, 62, in this embodiment, project above and below, respectively, the top and bottom edges 52, 54. The stopping members 60, 62, in this embodiment, extend between the inner surfaces of the side panels 46, 48, assisting to hold them in spaced relation.

The top edge 52 of each of the side panels 46, 48 includes an upward projection 64. Similarly, in this embodiment, the bottom edge 54 includes a downward projection 66. The upper projection 64 and stopping member 60 are spaced apart by a distance. That distance and the top edge 52 define a seat, generally indicated by 70, into which the weld nut 35 (FIG. 2) or other similar nut may rest. In this embodiment, a rectangular weld nut 35 may be advantageous, but a nut having another shape may be used in other embodiments. Suitable modifications to the shape of the projections 64, 66, and stopping members 60, 62 may be made so as to fit other shaped nuts in other implementations.

In some variations, the stopping members 60, 62 may be replaced by corresponding projections from the top edge 52 and bottom edge 54, respectively so as to define the seat 70. The stopping members 60, 62 may, in such embodiments be omitted or may be formed as cross members between the side panels 46, 48. In some cases, the two stopping members 60, 62 may be a single member, extending the height of the jack base 30, provided that a gap exists between the stopping member(s) and the cross member 50, such that a clamp, such as a worm gear clamp, may be inserted between the stopping member(s) and the cross member 50.

The jack base 30 of this example provides a secure base for the screw jack 26 (FIG. 2). The jack base 30 is easily secured to a horizontal pipe 20 using a clamp or other suitable fastener. In this embodiment, the jack base 30 is symmetrical top and bottom, meaning it can be easily used on either side of the pipe 20 by loosening the clamp and rotating the jack base 30 over to the other side. It will be appreciated that although the present example embodiment is symmetrical top and bottom that other embodiments may not be symmetrical. In one example embodiment the projections 64, stopping member 60 and seat 70 may be formed only on the top edge 52 and the bottom edge 54 may lack these features.

The side panels 46, 48 act as outwardly projecting arms that provide the structurally supported seat 70 into which the weld nut 35 of the screw jack 26 is placed. In some instances, the weld nut 35 may be lockingly friction fit to the seat 70 such as by way of small bosses (not shown) on the inside walls of the projections 64 and/or stopping member 60. In some other instances, the weld nut 35 may simply rest in the seat without any locking feature.

Once the screw jack 26 is fit to the jack base 30, the threaded shaft 32 is rotated until the contact pad 40 is brought to bear against the ceiling 14.

The foregoing example embodiments presume attachment of the jack base 30 to a horizontal pipe 20. It will be appreciated that other superstructures may be formed, and suitable modifications to the jack base 30 may be made for attachment to such superstructures. For example, the superstructure may be formed using rectangular beams instead of pipes, or horizontal structural members of other cross-sectional shapes. Jack bases 30 may be clamped, clipped, bolted/screwed, friction fit, or otherwise secured to the horizontal members.

The jack base 30 may be integrally formed in a molding process. In some instances the jack base 30 may be molded or otherwise formed from plastic. In some embodiments, the jack base 30 may be formed from machined or cast metal.

Figure 8:
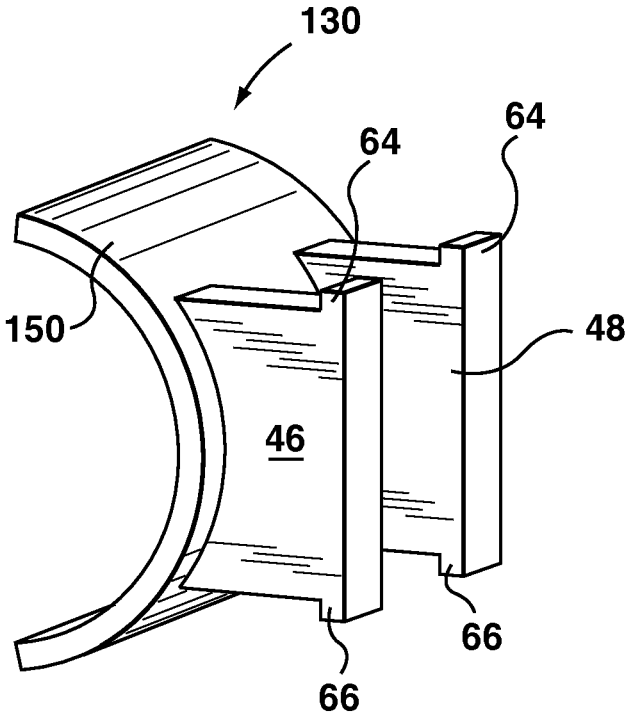
FIG. 8 is a perspective view of another example support device.
Figure 9:
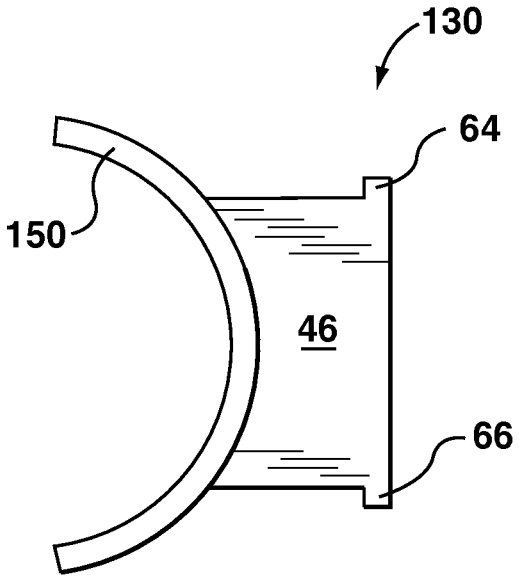
FIG. 9 shows a side view of the example support device of FIG. 8.

Reference is now made to FIGS. 8 and 9. FIG. 8 shows a perspective view of another example embodiment of a jack base 130, while FIG. 9 shows a side view of the jack base 130. The jack base 130 in this embodiment includes the side panels 46 and 48, and features the upward and downward projections 64 and 66, respectively. The jack base 130 includes a curved panel 150 from which the side panels 46, 48 project. The curved panel 150 has an interior surface radius about equivalent to the outer radius of the horizontal pipe to which it is to be mounted. The gap between the side panels 46, 48 allows passage of a worm gear clamp, or a similar fastener, for securing the jack base 130 to the pipe.

In the illustrated embodiment, the jack base 130 the curved panel 150 implements the function of the cross member 50 by structurally supporting the side panels 46, 48 and providing an attachment surface for securing the jack base 130 to the pipe. The curved panel 150 also serves as the stopping member 60, 62 (FIG. 4) since the weld nut may be sized to fit between the projections 64, 66 and the outer surface of the curved panel 150.

In some cases, the curved panel 150 may include a partial annular groove in its outer surface within which the worm gear clamp may fit.

Other variations and modifications to the jack base may be apparent to those ordinarily skilled in the art without materially affecting the function of the example embodiments described herein. All such variations and modifications are contemplated and intended to be included herein.

In one possible implementation, the system and device described herein may be used in connection with a plaster ceiling having a coved portion or other such three-dimensional features. For example, the superstructure may be constructed so as to have a horizontal pipe running parallel to and below or within the coved portion, which may run along the perimeter of the ceiling in some cases. The support devices may be attached to the horizontal pipe at angles from vertical so as to apply pressure against the cove face from different angles. In some cases the contact surface of the contact pad 42 may be convex or concave, so as to fit the three-dimensional curvature of the cove or other decorative features.

Certain adaptations and modifications of the described embodiments can be made. Therefore, the above discussed embodiments are considered to be illustrative and not restrictive.

What is claimed is:

1. a jack base comprising:

a screw jack having a longitudinal threaded shaft with a diameter and a nut on the threaded shaft;

two spaced apart side panels defining a gap between them at least as large as the diameter of the threaded shaft, each side panel having an inner edge at one end of the side panel, an outer edge at an opposing end of the side panel, and a top edge extending between the one end and the opposing end, wherein the top edges each have an upward protrusion proximate the outer edges;

a cross member extending between the two side panels proximate the inner edges; and a stopping member protruding above the top edges and spaced from the upward protrusions, whereby the top edges of the side panels between the upward protrusions and the stopping member form a seat for the nut when the threaded shaft is between the side panels, and whereby the jack base may be secured to a superstructure using a clamp passing between the side panels and over the cross member.

2. The jack base of claim 1, wherein the inner edges have a concave radius.

3. The jack base of claim 2, wherein the cross member has a surface continuous with at least a portion of the inner edges.

4. The jack base of claim 1, wherein the stopping member extends between the side panels.

5. The jack base of claim 1, wherein the stopping member comprises a first stopping member extending upwards from the top edge of one of the side panels, and a second stopping member extending upward from the top edge of the other of the side panels.

6. The jack base of claim 1, wherein the top edges between the stopping member and upward protrusions is planar.

7. The jack base of claim 1, wherein each side panel has a bottom edge opposite the top edge and extending between the one end and the opposing end, wherein the bottom edges each have a downward protrusion proximate the outer edges, and wherein the jack base further comprises a further stopping member protruding below the bottom edge and spaced from the downward protrusions, such that the jack base is symmetrical top to bottom.

8. The jack base of claim 1, wherein the clamp comprises a worm gear clamp.

9. The jack base of claim 1, wherein the stopping member and the cross member are formed from the same component.

10. A support device for supporting a plaster ceiling during conservation work, the support device comprising:

a jack base including two spaced-apart side panels defining a gap between them, each side panel having an inner edge at one end of the side panel, an outer edge at an opposing end of the side panel, and a top edge extending between the one end and the opposing end, wherein the top edges each have an upward protrusion proximate the outer edges, a cross member extending between the two side panels proximate the inner edges, and a stopping member protruding above the top edges and spaced from the upward protrusions;

a screw jack including a threaded shaft, a nut on the threaded shaft, a coupling nut on an upper end of the threaded shaft, and a contact pad on the upper end of the coupling nut, the threaded shaft having a diameter; and a clamp for securing the jack base to a horizontal pipe, wherein the clamp is a worm gear clamp passing between the side panels and around the cross member, wherein the gap is at least as large as the diameter, and wherein the top edges of the side panels between the upward protrusions and the stopping member form a seat for the nut when the threaded shaft is between the side panels, and whereby the jack base may be secured to a superstructure using the clamp.

11. The support device of claim 10, wherein the inner edges of the jack base have a concave radius.

12. The support device of claim 11, wherein the cross member has a surface continuous with at least a portion of the inner edges.

13. The support device of claim 10, wherein the stopping member extends between the side panels.

14. The support device of claim 10, wherein the stopping member comprises a first stopping member extending upwards from the top edge of one of the side panels, and a second stopping member extending upward from the top edge of the other of the side panels.

15. The support device of claim 10, wherein the top edges between the stopping member and upward protrusions is planar.

16. The support device of claim 10, wherein each side panel has a bottom edge opposite the top edge and extending between the one end and the opposing end, wherein the bottom edges each have a downward protrusion proximate the outer edges, and wherein the jack base further comprises a further stopping member protruding below the bottom edge and spaced from the downward protrusions, such that the jack base is symmetrical top to bottom.

17. The support device of claim 10, wherein the stopping member and the cross member are formed from the same component.

18. The jack base of claim 1, wherein the two spaced-part side panels have no connection between them proximate their outer edges, thereby providing a continuous open space between their outer edges through which the longitudinal threaded shaft passes to be seated in the jack base.

19. The support device of claim 10, wherein the two spaced-apart side panels have no connection between them proximate their outer edges, thereby providing a continuous open space between their outer edges through which the threaded shaft passes to be seated in the jack base.

* * * * *